US008555908B2

(12) United States Patent
Gross

(10) Patent No.: US 8,555,908 B2
(45) Date of Patent: Oct. 15, 2013

(54) SUPPORT SYSTEM FOR TENTS AND SHELTERS

(75) Inventor: Judith Deborah Gross, Fletcher, NC (US)

(73) Assignee: Heartfire Designs LLC, Fletcher, NC (US)

( * ) Notice: Subject to any disclaimer, the term of this patent is extended or adjusted under 35 U.S.C. 154(b) by 44 days.

(21) Appl. No.: 12/986,371

(22) Filed: Jan. 7, 2011

(65) Prior Publication Data

US 2011/0203628 A1 Aug. 25, 2011

Related U.S. Application Data

(60) Provisional application No. 61/307,576, filed on Feb. 24, 2010.

(51) Int. Cl.
*E04H 15/02* (2006.01)
*E04H 15/34* (2006.01)

(52) U.S. Cl.
USPC ..... 135/96; 135/114; 135/121; 135/905; 280/816; 280/820

(58) Field of Classification Search
USPC ..... 135/95–96, 121–122, 114, 120.3, 135/136–138, 905, 97, 116–117; 280/819, 280/823, 816, 820; 5/414, 418
See application file for complete search history.

(56) References Cited

U.S. PATENT DOCUMENTS

| | | | | |
|---|---|---|---|---|
| 2,547,073 | A * | 4/1951 | Bueler | 280/812 |
| 4,003,181 | A * | 1/1977 | Robinson et al. | 135/115 |
| 4,114,633 | A * | 9/1978 | Herbez | 135/97 |
| 4,541,445 | A * | 9/1985 | Ferguson | 135/138 |
| 4,594,735 | A * | 6/1986 | Rolf et al. | 2/89 |
| 4,762,339 | A * | 8/1988 | Hoek | 280/812 |
| 5,080,123 | A * | 1/1992 | Stein | 135/97 |
| 5,118,136 | A * | 6/1992 | Johnson | 280/812 |
| 7,406,977 | B1 * | 8/2008 | Shires | 135/97 |
| 7,673,642 | B1 * | 3/2010 | Shires | 135/136 |

FOREIGN PATENT DOCUMENTS

NZ 566266 A 6/2009

OTHER PUBLICATIONS http://web.archive.org/web/20050406023200/www.wanderlustgear.com/tents_designfactors.htm; WanderLust Outdoor Gear; What makes Wanderlust tents different from other shelters? Apr. 6, 2005.
Intellectual Property Office of New Zealand; Journal 1545; p. 39; Mar. 28, 2008.

* cited by examiner

*Primary Examiner* — Winnie Yip
(74) *Attorney, Agent, or Firm* — The Van Winkle Law Firm; David M. Carter

(57) ABSTRACT

A system for structural support of light weight outdoor tents and shelters utilizing two or more hiking or trekking poles and a connecting light weight ridge pole assembly that serves as the roof support truss providing the occupant(s) will full head room use for the width of the ridge pole assembly.

17 Claims, 3 Drawing Sheets

SUPPORT SYSTEM FOR TENTS AND SHELTERS

RELATED APPLICATION

This is a U.S. non-provisional application relating to and claiming the benefit of U.S. Provisional Patent Application Ser. No. 61/307,576, filed Feb. 24, 2010.

BACKGROUND OF INVENTION

The sports or hobbies of backpacking, hiking, and camping often involve the use of a tent or similar shelter to provide protection from the elements and pests. As used herein, the term "tent(s)" shall include tent(s) and other similar shelter (s). Usable space and low weight are important features of these tents often adding to the enjoyment and success of the activity. Tents most often use traditional sectioned tent poles spanning the entire verticality on the outside of the tent or in an outside sleeve to support the body of the structure. Because many hikers and backpackers already carry hiking or trekking poles, some tents have been developed employing hiking or trekking poles rather than tent poles to limit the weight carried. As used herein, "trekking pole(s)" shall include hiking pole(s) and trekking pole(s). The prior art has many examples of tents utilizing trekking poles employing a set of grommets or caps with tie out cords to hold the tips of the poles up and in place. They are normally standing vertically or in an inverted "V," cone, or teepee configuration. In this format, the usable space and headroom in the tent is compromised whether by the poles themselves or the shape of the tent roof. The inverted "V" shape is not conducive to the shape of one's head and therefore the user cannot benefit from the full measured internal height of the structure. The ultimate height of the peak is limited by the length of the trekking pole and if the pole is set up vertically, it is often in a precarious position waiting to be knocked over causing the tent to collapse.

SUMMARY OF THE INVENTION

In accordance with one form of this invention, there is provided a tent frame assembly, including first and second trekking poles. Each trekking pole has a first end and a second end. A bracket is provided. The bracket has an elongated central portion and first and second end portions. The first and second end portions each have an opening therein. The opening in the first end portion of the bracket is adapted to receive the second end of the first pole and the opening in the second end of the bracket is adapted to receive the second end of the second pole, thereby forming a roof support truss for a tent. Preferably, the first end of each trekking pole is a grip end and the second end is a tip end.

In accordance with another form of this invention, there is provided a tent assembly, including a tent formed from fabric. The tent includes an upper portion having an elongated top ridge. The tent has at least first and second side walls. A frame assembly is provided. The frame assembly includes first and second trekking poles. Each trekking pole has a first end and a second end. A bracket is provided having an elongated central portion and first and second end portions. The first and second end portions each have an opening therein. The opening of the first end portion of the bracket is adapted to receive the second end of the first pole and the opening in the second end portion of the bracket is adapted to receive the second end of the second pole. The central portion of the bracket is adjacent to and supports the elongated top ridge of the tent, so that the inside of the tent has substantial head room adjacent to the elongated top ridge.

In accordance with yet another form of this invention, there is provided a tent assembly, including a tent formed from fabric. The tent has an upper portion forming an elongated top ridge and at least first and second side walls. A tent frame assembly is provided and includes first and second trekking poles, each having a grip end and a tip end. A bracket having an elongated central portion and first and second end portions is provided. The first and second end portions each have openings therein. The opening in the first end portion of the bracket receives the tip end of the first trekking pole and the opening in the second end portion of the bracket receives the tip end of the second trekking pole. The central portion of the bracket is adjacent to and supports the elongated top ridge of the tent on the inside of the tent so that the tent has substantial head room adjacent to the elongated top ridge. The trekking poles and bracket form a roof truss for the tent. A first angle is formed between the central portion of the bracket and the first end portion. A second angle is formed between the central portion of the bracket and the second end portion. The first and second angles range between one hundred forty degrees and ninety-five degrees. The length of the central portion of the bracket ranges between eight inches and twenty-four inches. The length of each of the trekking poles may be adjustable. The tent has a floor and the frame assembly is on the inside of the tent. The grip ends of the first and second trekking poles contact the floor of the tent.

PREFERRED EMBODIMENTS OF THE INVENTION

Figure 1:
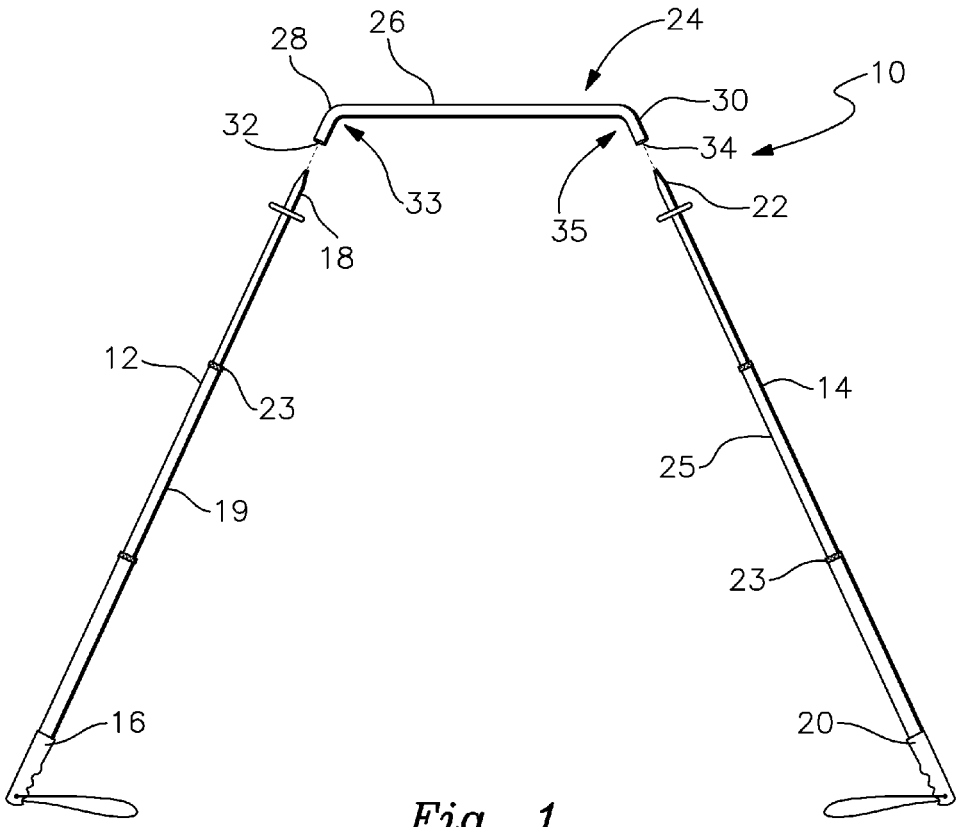
FIG. 1 is an exploded view of a tent frame assembly illustrating one embodiment of the invention.

Referring now more particularly to FIG. 1, there is provided tent frame assembly 10, including a first trekking pole 12 and a second trekking pole 14. Preferably, the trekking poles are adjustable. Trekking pole 12 includes a first end, which is the grip end 16, and a second end, which is the tip end 18, and an adjustable shaft 19 therebetween. Trekking pole 14 includes grip end 20 and tip end 22 and adjustable shaft 25 therebetween. Trekking poles 12 and 14 are adjustable in length by the use of an adjustment mechanism, such as adjustment mechanism 23 located on shafts 19 and 25, which are known to those skilled in the art. Adjustment mechanism 23 is rotated in one direction to permit the length of the trekking pole to be adjusted and is rotated in the opposite direction to maintain the trekking pole at a fixed length after the adjustment has been made. Alternatively, a flick-lock type adjustment mechanism may be used. When used in connection with tent frame assembly 10, trekking poles 12 and 14 are preferably adjusted to the same length, particularly if the tent is to be mounted on level ground. If the tent is to be mounted on a slope, one of the trekking poles could be made longer than the other to accommodate the differences in ground level.

Tent frame assembly 10 includes a ridge pole or bracket 24 having an elongated central portion 26, first end portion 28, and second end portion 30. Bracket 24 is preferably a hollow tube made of a light weight and somewhat flexible material such as plastic. End portion 28 includes opening 32 and end portion 30 includes opening 34. Opening 32 receives tip end 18 of trekking pole 12. Opening 34 receives tip end 22 of trekking pole 14. Preferably, the length of the central portion 26 of bracket 24 is between eight inches and twenty-four inches and more preferably, between ten inches and twelve inches.

There is a bend at the intersection of central portion 26 of elongated bracket 24 and first end portion 28 forming angle 33. In addition, there is a bend at the intersection of central portion 26 of elongated bracket 24 and second end portion 30 forming angle 35. Preferably, the angles 33 and 35 are between one hundred forty degrees (140°) and ninety-five degrees (95°) and more preferably, between one hundred fifteen degrees (115°) and one hundred five degrees (105°).

When trekking poles 12 and 14 and bracket 24 are fully assembled together, a roof truss configuration for tent 34 is formed.

Figure 2:
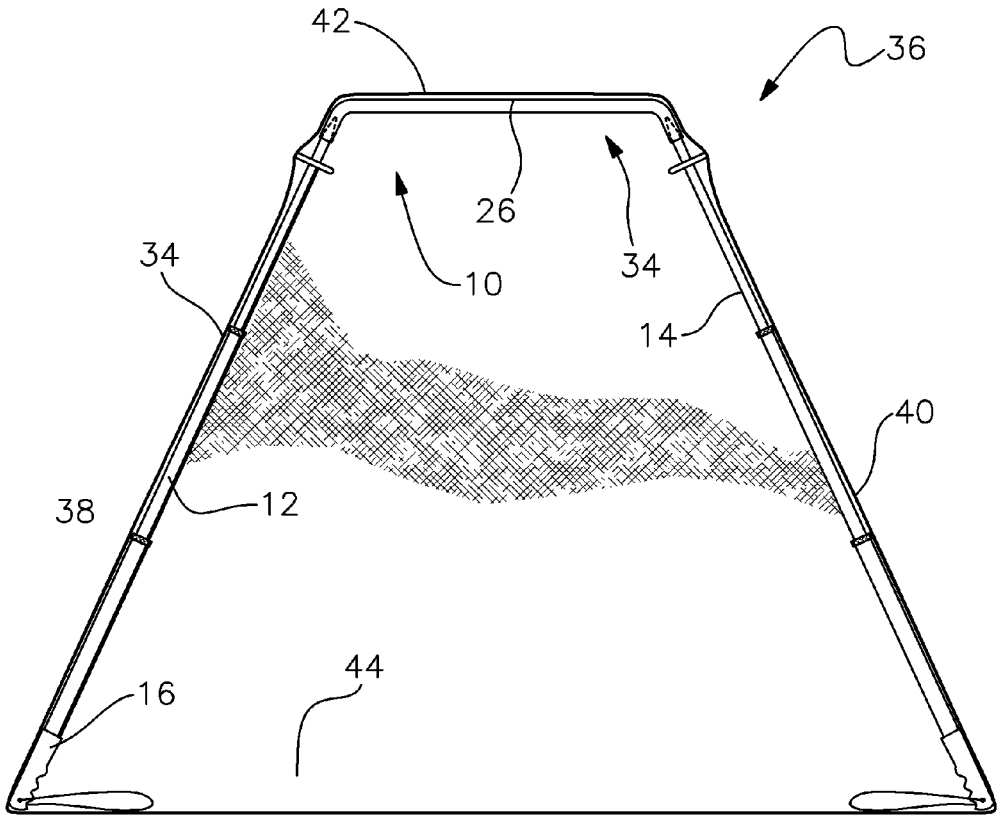
FIG. 2 is a sectional view of a tent with the tent frame assembly of FIG. 1 mounted on the inside of the tent.
Figure 3:
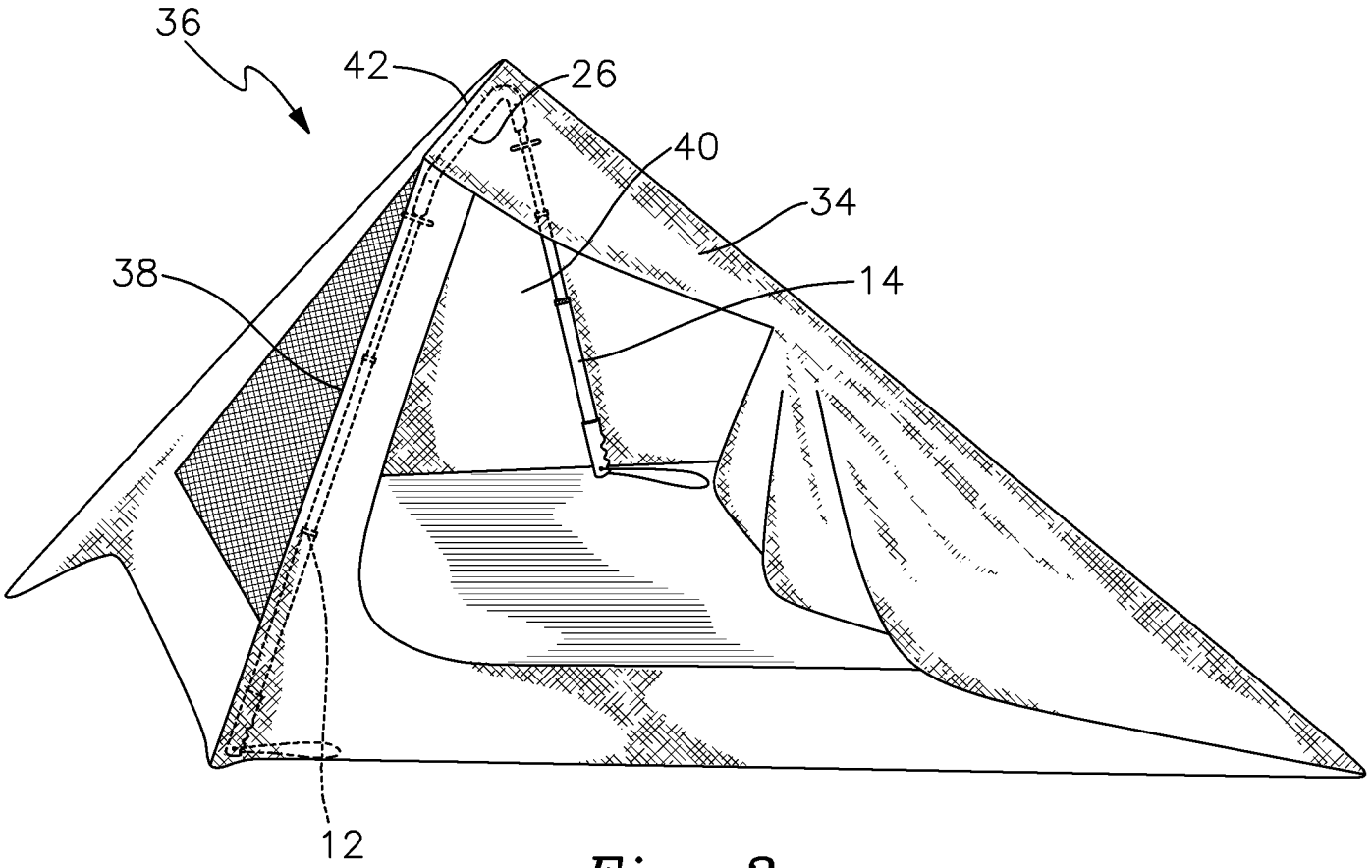
FIG. 3 is a perspective view of a tent with the tent frame assembly of FIG. 1 on the inside of the tent.

Referring now more particularly to FIGS. 2 and 3, tent assembly 36 is provided. Tent assembly 36 includes tent frame assembly 10 and tent 34, which is made of fabric, preferably primarily light weight nylon. Tent 34 includes at least a first side wall 38 and a second side wall 40. Tent 34 further includes elongated top ridge 42, which is located between first side wall 38 and second side wall 40. Preferably, tent 34 also includes floor 44.

In the embodiment of FIG. 2, tent frame assembly 10 is received on the inside of tent 34. Central portion 26 of bracket 24 rests against and supports the inside surface of elongated top ridge 42. Since top ridge 42 is elongated and the central portion 26 of bracket 24 is elongated, there is substantial head room inside of tent assembly 36. The head room is equal to the length of central portion 26 of bracket 24.

In the embodiment of FIG. 2, first trekking pole 12 is on the inside of tent 34 and is adjacent to first wall 38. Grip end 16 of trekking pole 12 rests against the tent floor 44. Trekking pole 14 is also on the inside of tent 34, but is adjacent to second wall 40. Grip end 20 of trekking pole 14 rests against floor 44.

The angle of trekking poles 12 and 14 is determined by the design and shape of tent 34 and is accommodated by the appropriate bending of ends 28 and 30 of bracket 24 forming angles 33 and 35.

The invention enables the portion of the tent at the location of the roof truss formed by the connection of the trekking poles 12 and 14 to bracket 24 to become free standing. Thus, tent stakes are not necessary to hold down the tent floor at these points, particularly with the embodiment of FIG. 2.

The invention allows an ultra-light backpacking tent while providing comfort in the form of spacious accommodations. If only two trekking poles are used per structural roof truss, the axis of the support system is perpendicular to the body position while sleeping. The ridge pole or bracket 24 is preferably made of a lightweight and somewhat flexible material such as plastic. The ends 28 and 30 of bracket 24 should be bent in a way that is a slightly greater angle than the desired angle of the tent wall such that insertion of the trekking poles and erection of the tent enables the shape and design of the tent fabric to impart a compression force to the bracket forcing the trekking poles outward and thereby providing a taut setting of the tent fabric and holding the entire structure firmly in place, allowing for strong wind resistance. The trekking pole tips 18 and 22 taper and the ends must be inserted into the open ends 32 and 34 of the bracket 24 which is typically ~0.5 inches diameter. Use of adjustable trekking poles allows for internal adjustment for sagging and re-tightening. The bracket 24 includes an elongated straight central portion 26 and two end portions 28 and 30 which form connectors. Each end portion includes an open end 32 and 34 for receiving trekking pole tips 18 and 22. There are angled bends 33 and 35 forming transitions between the elongated straight portion 26 and the connector portions 32 and 34. Preferably, each bend forms an angle ranging between one hundred forty degrees (140°) and ninety-five degrees (95°) with respect to the elongated straight portion. More preferably, the bend angle is between one hundred fifteen degrees (115°) and one hundred five degrees (105°). Preferably, the length of the elongated straight portion is in a range between eight (8) inches and twenty-four (24) inches and more preferably is between ten (10) inches and twelve (12) inches to provide adequate head space.

From the foregoing description of one embodiment of the invention, it will be apparent that many modifications may be made therein. It will be understood that this embodiment of the invention is an exemplification of the invention only and that the invention is not limited thereto.

The invention claimed is:

1. A tent frame assembly comprising:

first and second trekking poles; each trekking pole having a first grip end and a second tip end;

a bracket; the bracket having an elongated central portion and first and second end portions; the first and second end portions each having openings therein; the opening in the first end portion of the bracket adapted to receive the second tip end of the first trekking pole and the opening in the second end portion of the bracket adapted to receive the second tip end of the second trekking pole, the first grip end of each trekking pole being adapted to be supported by the ground, thereby forming a roof support truss for a tent;

a first angle formed between the central portion and the first end portion and a second angle formed between the central portion and the second end.

2. A tent frame assembly as set forth in claim 1 wherein the bracket adapted to support an upper portion of the tent.

3. A tent frame assembly as set forth in claim 1 wherein the trekking poles and the bracket is hollow and is flexible.

4. A tent frame assembly as set forth in claim 1 wherein the length of the central portion of the bracket ranges between eight inches and twenty-four inches.

5. A tent frame assembly as set forth in claim 4 wherein the length of the central portion of the bracket ranges between ten inches and twelve inches.

6. A tent frame assembly as set forth in claim 1 wherein the bracket is a hollow tube; the first and second angles ranging between one hundred forty degrees and ninety-five degrees.

7. A tent frame assembly as set forth in claim 6 wherein the first and second angles range between one hundred fifteen degrees and one hundred five degrees.

8. A tent assembly comprising:

a tent formed from fabric; the tent having an upper portion forming an elongated top ridge; the tent having at least first and second side walls;

a frame assembly including first and second trekking poles; each trekking pole having a first grip end and a second tip end;

a bracket; the bracket having an elongated central portion and first and second end portions; the first and second end portions each having openings therein; the opening in the first end portion of the bracket adapted to receive the second tip end of the first trekking pole and the opening in the second end portion of the bracket adapted to receive the second tip end of the second trekking pole, and the first grip end of each trekking pole being adapted to be supported by the ground;

the central portion of the bracket adjacent to and supporting the elongated top ridge of the tent whereby the inside of the tent has substantial head room adjacent to the elongated top ridge;

a first angle formed between the central portion and the first end portion and a second angle formed between the central portion and the second end.

9. A tent assembly as set forth in claim 8 wherein the trekking poles and the bracket form a roof truss for the tent.

10. A tent assembly as set forth in claim 8 wherein the central portion of the bracket is substantially straight; the length of the central portion of the bracket ranging between eight inches and twenty-four inches.

11. A tent assembly as set forth in claim 10 wherein the length of the central portion of the bracket ranges between ten inches and twelve inches.

12. A tent assembly as set forth in claim 8 wherein the bracket is a hollow tube; first and second angles range between one hundred forty degrees and ninety-five degrees.

13. A tent assembly as set forth in claim 12 wherein the first and second angles range between one hundred fifteen degrees and one hundred five degrees.

14. A tent assembly as set forth in claim 8 wherein the frame assembly is on the inside of the tent; the central portion of the bracket contacting the elongated top ridge on the inside of the tent.

15. A tent assembly as set forth in claim 14 wherein the tent includes a floor; the grip ends of the first and second trekking poles contacting the floor of the tent.

16. A tent assembly as set forth in claim 15 wherein the first trekking pole is adjacent to the first side wall and the second trekking pole is adjacent to the second side wall; the first trekking pole exerting a force on the first side wall wherein the first side wall is pulled taut; the second trekking pole exerting a force on the second side wall wherein the second side wall is pulled taut.

17. A tent assembly comprising:

a tent formed from fabric; the tent having an upper portion forming an elongated top ridge; the tent having at least first and second side walls;

a frame assembly including first and second trekking poles; each trekking pole having a grip end and a tip end;

a bracket; the bracket having an elongated central portion and first and second end portions; the first and second end portions each having openings therein; the opening in the first end portion of the bracket adapted to receive the tip end of the first pole and the opening in the second end portion of the bracket adapted to receive the tip end of the second pole;

the central portion of the bracket being adjacent to and supporting the elongated top ridge of the tent on the inside of the tent whereby the tent has substantial head room adjacent to the elongated top ridge;

the trekking poles and the bracket forming a roof truss for the tent;

a first angle formed between the central portion of the bracket and the first end portion and a second angle formed between the central portion of the bracket and the second end portion; first and second angles ranging between one hundred forty degrees and ninety-five degrees;

the length of the central portion ranging between eight inches and twenty-four inches;

the length of each of the trekking poles being adjustable;

the tent having a floor;

the frame assembly being on the inside of the tent;

the grip ends of the first and second trekking poles contacting the floor of the tent.

* * * * *